US007264004B2

(12) United States Patent
Djulbegovic

(10) Patent No.: US 7,264,004 B2
(45) Date of Patent: Sep. 4, 2007

(54) HAIR DRYING/STYLING DEVICE

(76) Inventor: Dzenana Djulbegovic, 905 Mix Ave., #T7, Hamden, CT (US) 06514

( * ) Notice: Subject to any disclaimer, the term of this patent is extended or adjusted under 35 U.S.C. 154(b) by 317 days.

(21) Appl. No.: 10/922,090

(22) Filed: Aug. 19, 2004

(65) Prior Publication Data

US 2005/0039770 A1 Feb. 24, 2005

Related U.S. Application Data

(60) Provisional application No. 60/496,788, filed on Aug. 21, 2003.

(51) Int. Cl.
*A45D 1/00* (2006.01)

(52) U.S. Cl. ..... 132/227; 132/238; 132/271; 34/96

(58) Field of Classification Search ..... 132/119.1, 132/120, 122, 271, 272, 237, 238, 262, 268; 34/96, 97, 98, 283
See application file for complete search history.

(56) References Cited

U.S. PATENT DOCUMENTS 2,258,920 A * 10/1941 Yates ..... 132/258
3,835,869 A * 9/1974 Newman et al. ..... 132/271
3,894,547 A * 7/1975 Scivoletto ..... 132/119.1
3,901,249 A * 8/1975 Russell ..... 132/271
4,409,998 A * 10/1983 Bauer ..... 132/227
4,664,132 A * 5/1987 Schillig ..... 132/271
4,906,804 A * 3/1990 Theimer ..... 200/52 R
5,144,756 A * 9/1992 Miscione ..... 34/60
5,275,183 A * 1/1994 Landry ..... 132/271
5,979,463 A * 11/1999 Santy et al. ..... 132/120
6,098,635 A * 8/2000 Marino ..... 132/238
6,782,636 B2 * 8/2004 Feldman ..... 34/96
2003/0131865 A1 * 7/2003 Richmond et al. ..... 132/119.1

FOREIGN PATENT DOCUMENTS

WO WO93/25111 * 12/1993

* cited by examiner

*Primary Examiner*—Todd E. Manahan

(57) ABSTRACT

A hair drying/styling device which combines a uniquely designed rotating hairbrush and blow dryer into a single product. The present invention simplifies the popular styling technique of brushing hair while applying the blow dryer, by allowing the user to completely disregard the blow dryer, as this operation is automated by the product. The user has the comfort of performing both of these vital tasks with one hand, providing the other hand with the freedom necessary to part and prepare each section of the hair for treatment. Furthermore, the present invention introduces a new rotating hairbrush specifically designed to prevent tangling and overheating of the hair—two of the most common complaints with users of prior art.

1 Claim, 6 Drawing Sheets

P
A
RB

A
P

HAIR DRYING/STYLING DEVICE

I, Dzenana Djulbegovic, claims benefit of U.S. provisional patent application No. 60/496,788, filed on Aug. 21, 2003.

FIELD OF THE INVENTION

The present invention relates in general to a blow dryer and a rotating hairbrush, more specifically, combining the two into a single product to achieve professional hair-styling results at a fraction of the time and cost.

BACKGROUND OF THE INVENTION

Hairstyles, throughout history, have always reflected social values and the culture of the time, and to this day, people are highly concerned with their outward appearance. Women have invested a tremendous amount of money, time, and effort into their hair for various reasons—to feel beautiful, to get noticed, or simply to acquire that special sense of confidence that comes with looking good. There are a number of salons that offer professional styling, but only for the few of us who have the time and money for it. The vast majority of women worldwide rely on home products that promise healthy, great looking hair and easy maintenance from the comfort of your own home. So far, the difference between the two has been apparent, and every woman still dreams of achieving those professional results at home.

DESCRIPTION OF PRIOR ART

A common technique for classic styling is the simultaneous use of a styling brush in one hand and a blow dryer in the other. This technique, although effective, has proven to be very difficult. The usage of both hands is required for sectioning of the hair, while constantly turning and pulling the brush, therefore making it impossible to apply the blow dryer at the same time. So, the user is forced to put the dryer aside and pick it up 15-20 times during the process, in order to equally apply to every portion of her hair.

The closest we have to a solution to the above problem is a new self-rotating brush that has recently become available on the market. The big help (amongst other advantages) comes from not having to constantly tug and turn on the brush yourself. However, when used along with the hair-dryer, the product still fails to provide the user with comfort and freedom for the other hand necessary for action.

Hot tools have also become popular for creating a variety of desired hairstyles, such as curling irons, hot-air/brushes, straighteners, etc. But, these can be very time consuming and leave the hair unevenly dried. Moreover, they are well known to cause damage in the long run because of the application of excessive heat directly to the hair. And why put our already damaged hair through further abuse? The average woman's hair has suffered a lifetime of abuse through dying and improper use of dryers and hot tools, and is therefore in need of proper treatment.

The present invention will provide ultimate comfort and freedom. It will be designed to deliver professional results through a simplified technique that anyone can use. Regular usage of the present invention will minimize the risk of damage, increase comfort and provide users with full range of motion for either hand. Furthermore, the time necessary for full styling with this product will be reduced to that of an ordinary blow-drying.

SUMMARY OF THE INVENTION

The present invention is a unique system, which combines two products into a single more effective one to provide unique styling results. A blow dryer is attached to the handle of a rotating hairbrush and is integrally formed as a part of the main body. The blow dryer has an elongated body positioned above the hairbrush head, and is designed to overlay the brush in full length. The purpose of such a design is to direct a high-velocity airflow at a 90° angle, distributing it evenly from an optimal distance towards the rotating brush.

When combined, the blow dryer and the rotating hairbrush play essential roles to give the best possible styling results from a single product. However, the handle portion of the Hair Dryer Styler would have three side switches, two of which would allow either to be used independently, while the third switch would control the direction of spin for variation of style. The bidirectional spin would also prove very useful for left handed users, who are often left out by designers of many of today's products.

A vital part of the present invention is a uniquely designed rotating hairbrush. The head of the brush consists of eight slightly rounded blades and eight notches that serve different purposes. Only three of the notches would be filled with pure boar bristles that stick out 8-10 millimeters above the edges of the blades, while one of the edges extends slightly in a form of a simple comb.

The number one reason for superiority of the present invention over the prior art is simplicity. The consumer will be able to completely disregard the blow dryer, allowing him/her to focus entirely on achieving the desired hairstyle. The only necessary skills that the user need possess would be the ability to gather a portion of his or her own hair and extend it away, while positioning the rotating hairbrush correctly. All other functions—such as drying, de-tangling, straightening, and styling—would be performed automatically by the product.

Several other advantages of the present invention consist of the following:

- The fixed position of the elongated body of the blow dryer would ensure optimal distance with respect to the rotating brush, thus minimizing the risk of overheating and/or damaging hair, which is usually caused by incorrect usage of existing dryers and styling tools.
- The unique design of the hairbrush itself will provide the user with absolute control of the hair. The built-in extension comb will work to untangle and section small portions of hair, then guide the hair to be thoroughly brushed out with pure boar bristles. This technique is primarily intended for keeping the hair still and away from blowing out in all directions. To further maintain maximum control, the brush is only partially covered with bristles to eliminate tangling, while providing results of a regular brush since rotating at an adjustable speed (30-60 rotations per minute).
- As the hairbrush rotates, the blades will serve the following purposes:
  1. To help provide a constant pulling motion and greater tension upon the hair (mostly suitable for straightening).
  2. To prevent overheating of both the brush and the hair, since only a small portion of the surface of the brush (the edges) come in full contact with the hair.
  3. To produce a two-way airflow and thoroughly dry the hair from scalp to the ends, from below as well as from above, as the concentrated air returns from the brush via the notches between the blades.

The present invention will minimize the combined weight on the wrist and arm of the user. The tendency of the rotating brush to rise as it curls toward the top allows the user to maintain control by applying a natural, downward motion, which will provide weight balance.

Alternate embodiments of the invention may include:

A fourth notch on the brush that may be filled with rare plastic bristles to detangle the desired portions of hair before the intensive brushing of the boar bristles. This alternation would replace the existing extension comb on one of the blades.

Various style brushes (which would vary in size and shape) that can be readily attached to the handle of the rotating brush in order to precisely achieve the desired hairstyle. Another interesting option would be to consider attaching other styling tools (such as spirals, etc.) to further expand the possibilities of the Hair Dryer Styler.

A special production line intended for professional styling salons.

DETAILED DESCRIPTION OF THE DRAWINGS

Figure 1:
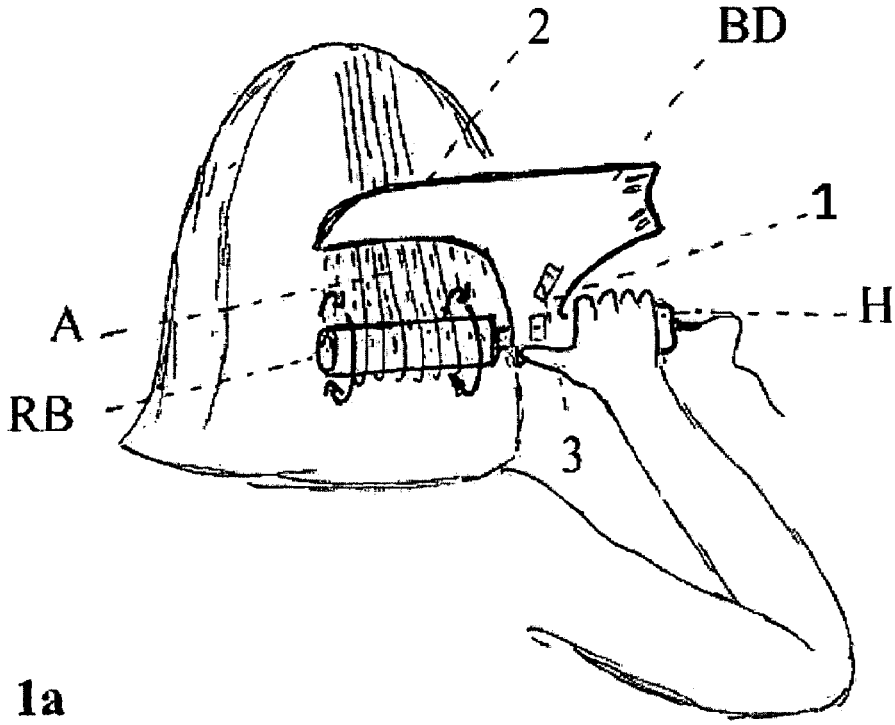
FIG. 1 and FIG. 1*a* is a perspective view of the invention to roughly show how it will function.
Figure 1A:
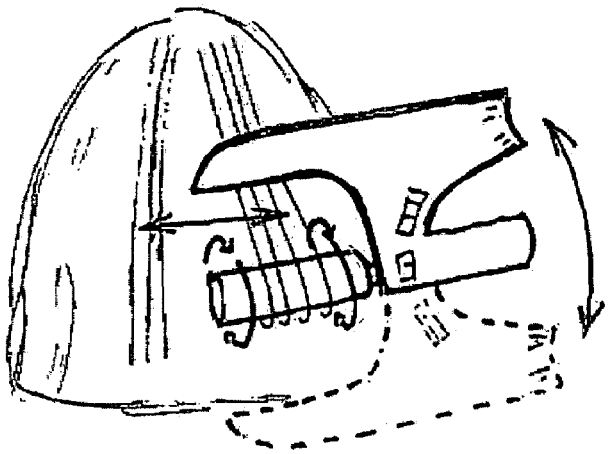
Figure 2:
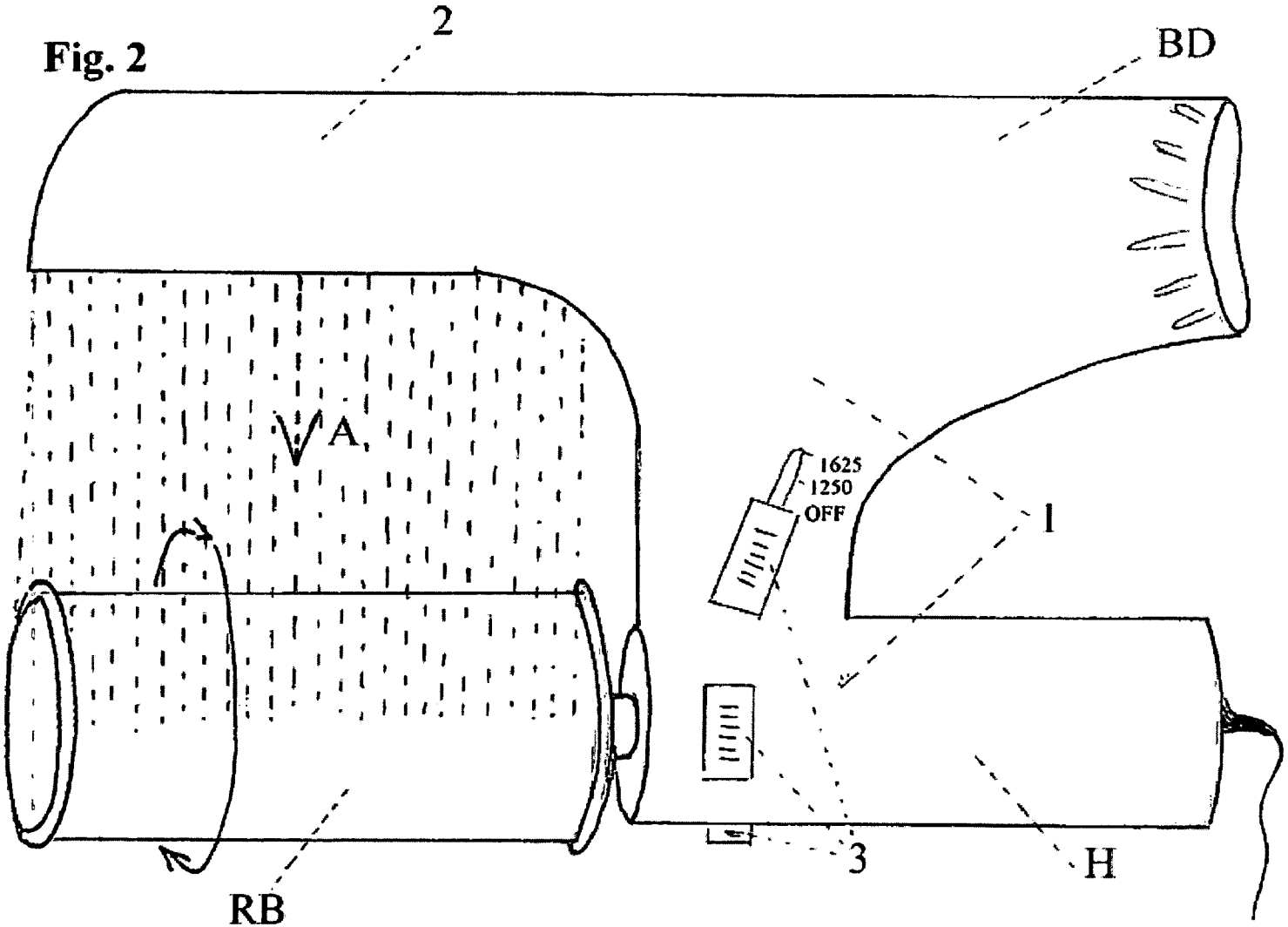
FIG. 2 illustrates how the different vital parts of the invention are integrated into this new, unique product.

FIG. 1 serves as an introductory drawing in order to illustrate the overall look and benefits of the product. The one-handed usage in FIG. 1 shows the simplicity of the invention while operating, and the flexibility and freedom of motion are represented in FIG. 1*a*. The user needs only to hold the product steady with one hand, while selecting a portion of hair to be treated with the other. Everything else is performed automatically by the Hair Dryer/Styler Referring to FIG. 2, we can observe the structure of the present invention and functionality of its three vital parts:

1. The main body (1), integrally formed with the handle (H) portion of the rotating hairbrush and the blow dryer (BD)
2. The elongated body (2), designed to overlay the hairbrush in full length and direct a high-velocity airflow (A) at a 90° angle towards the rotating brush (RB)
3. The uniquely designed hairbrush (RB)

Figure 3:
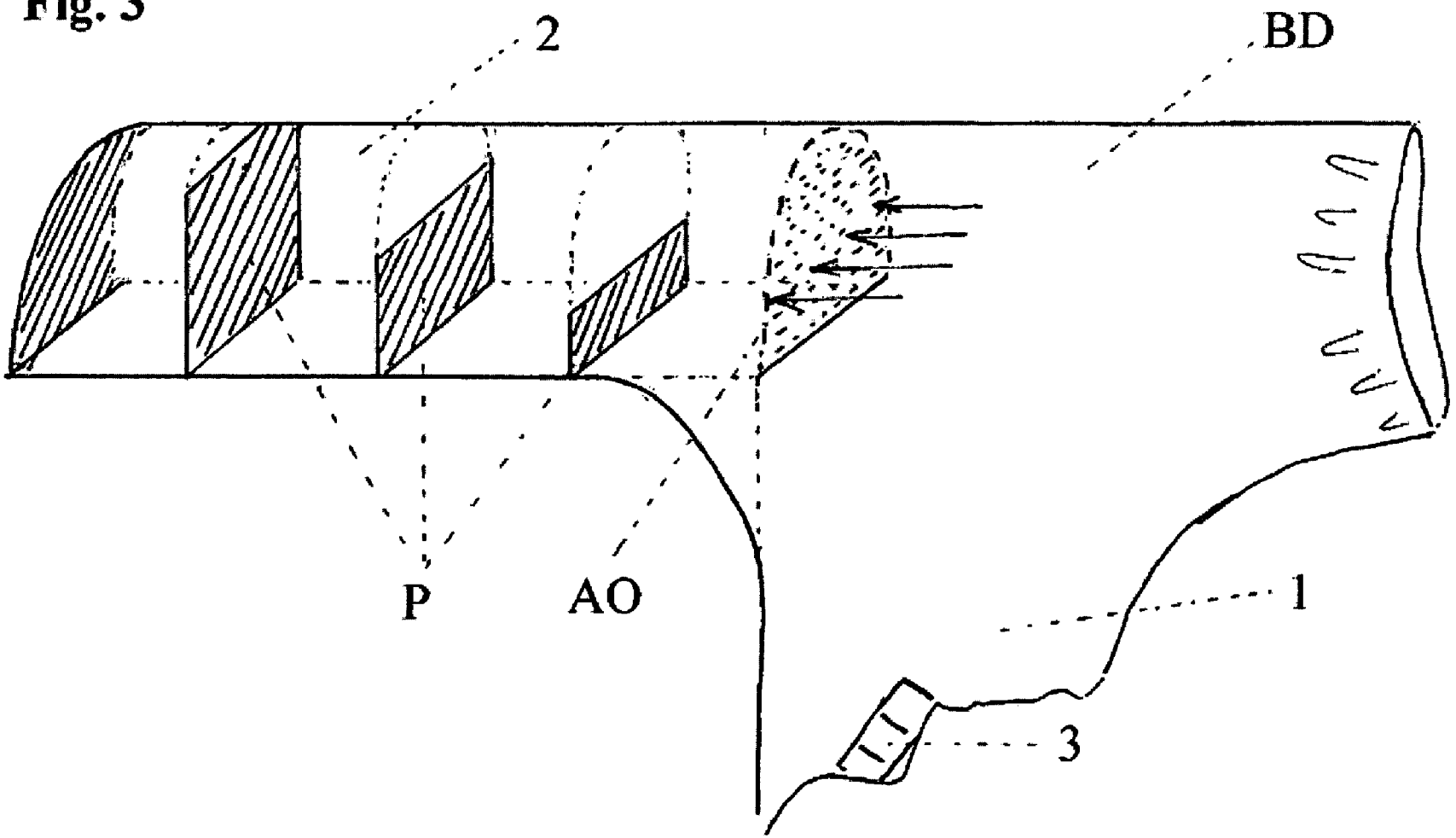
FIG. 3 is an interior view of the blow dryer, showing the basic principle behind the elongated body and the inserted plates, and how they work to conduct the airflow.

FIG. 3 illustrates the function and internal structure of the elongated body (2). The air outlet (AO) between the blow dryer (BD) and the elongated body is precisely designed to fit the shape of the elongated body to maximize the airflow effect. Inside the elongated body, several plates (P) are inserted and positioned evenly in ascending order. The purpose of each of these is to divide the airflow, so that they direct only the air they contact toward the hairbrush, while letting the remainder through to the next plate.

Figures 3A, 3B:
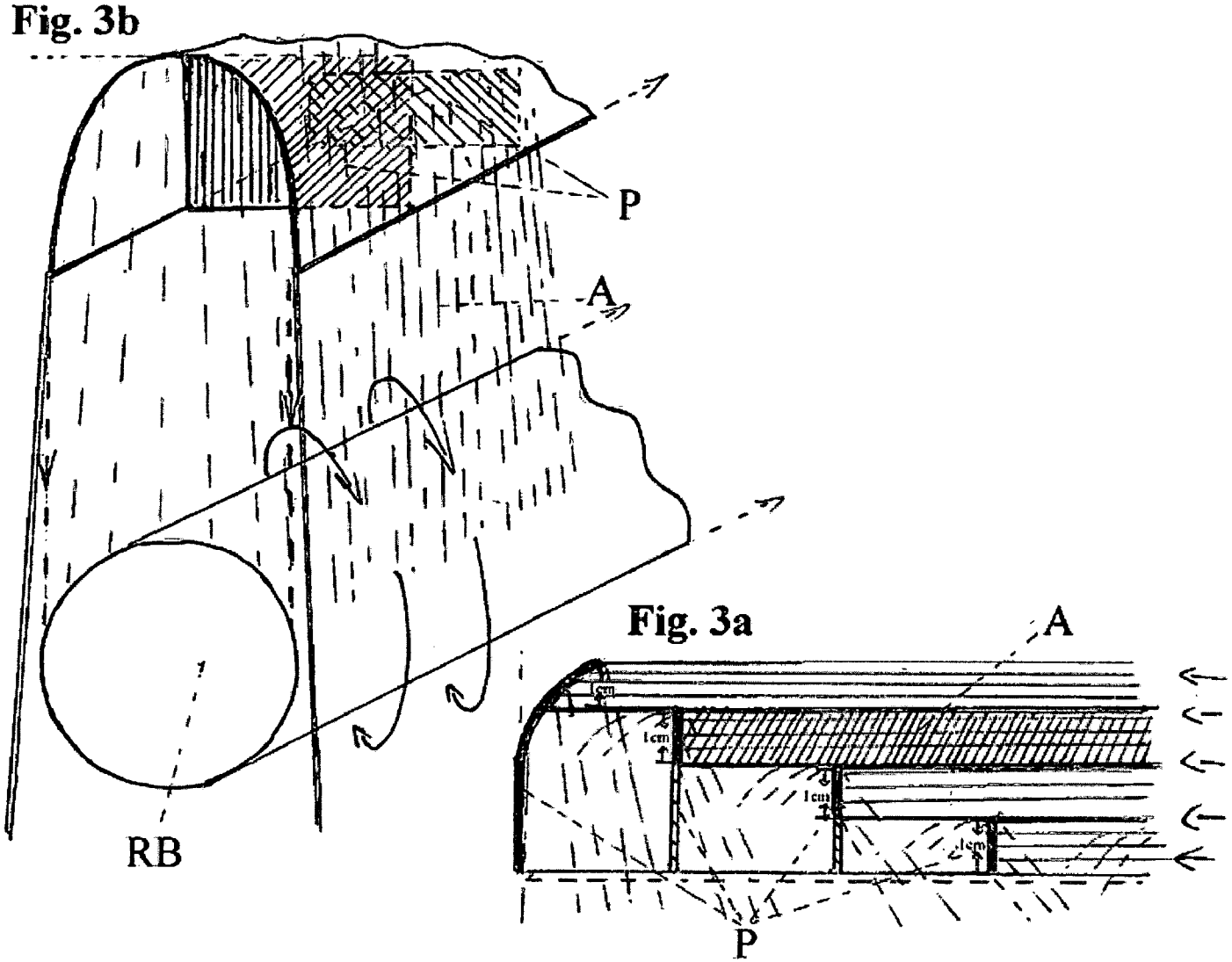
FIG. 3*a* is a detailed version of the previous drawing, shown in plain view.
FIG. 3*b* shows how the elongated body is designed to overlay the hairbrush and evenly distribute the airflow towards the brush.

FIG. 3*a* is a detailed version the above drawing and illustrates the airflow more accurately from a two-dimensional side-view. Here, the plates (P) increase by 1 cm as we move toward the end of the elongated body, and the air is conducted at four different levels.

FIG. 3*b* clearly shows the ultimate purpose of the elongated body structure-to transfer the air towards the brush. Making this possible is the elongated body, precisely designed to overlay the hairbrush, FIG. 4 is a detailed drawing of the uniquely designed rotating hairbrush, which is an essential part of the present invention and critical for achieving various professional hairstyles. Here we can observe the make-up of the brush:

1. 8 notches and 8 slightly rounded blades (so that they do not cut through the hair)
2. 3 of the notches, filled with pure boar bristles that stick out 8-10 mm. above the blades
3. A short, rare extension comb (also 8-10 mm. above the blades)
4. 2 caps (CP), the outer, with ventilation holes to regulate airflow and prevent overheating, and the inner (closer to the handle), closed to block the hot air from reaching the user's hand A detailed description of the full benefits of such a designed brush is provided in the Summary of the Invention—Benefits.

Figure 4A:
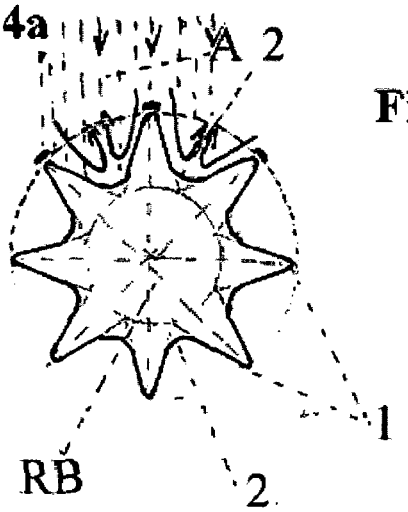
FIG. 4*a* and FIG. 4*b* are subsequent drawings of the brush in natural progression.
Figure 4B:
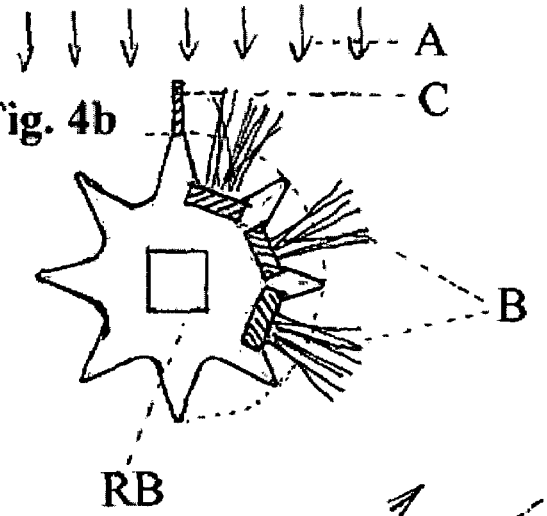
Figure 4:
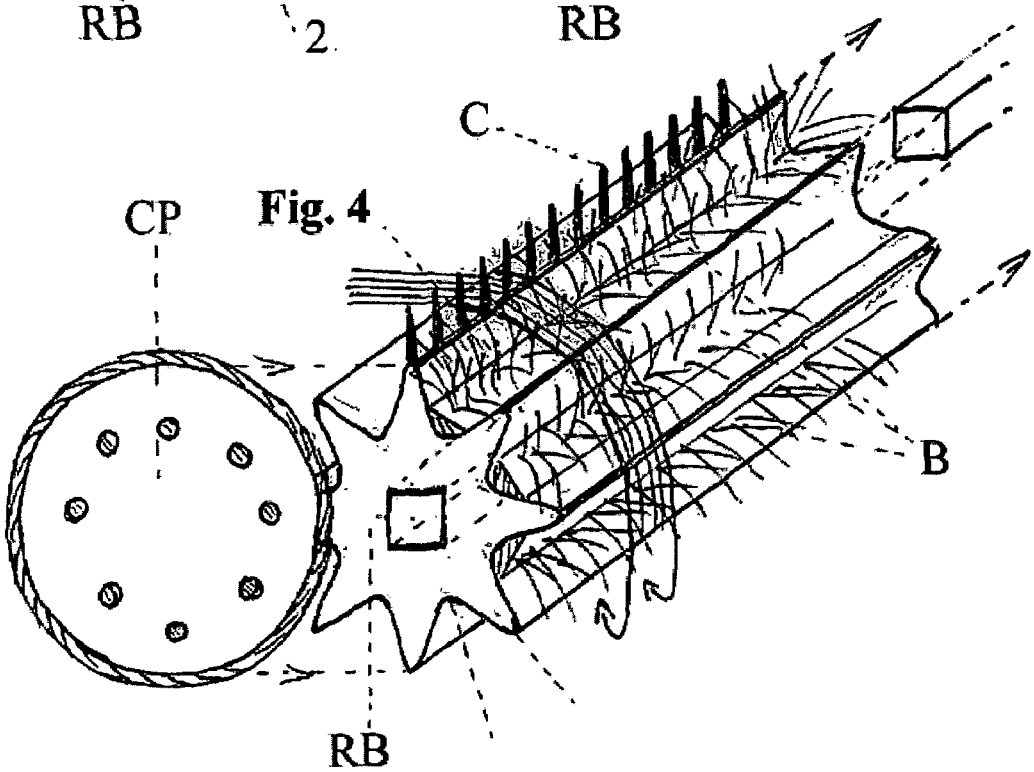
FIG. 4 precisely illustrates the hairbrush from a perspective view.

FIG. 4*a* is a plain view which precisely captures the workflow of the blades (1) and notches (2) and their common purposes:

1. To provide greater tension upon the hair (for straightening)
2. To prevent overheating of both the brush and the hair (since only the tips of the blades come in contact with the hair)
3. To produce a two-way airflow as the concentrated air returns FIG. 4*b* is another plain view, which more accurately depicts the positioning of the extension comb (C) and bristles (B) in relation to the blades and notches.

Figure 5:
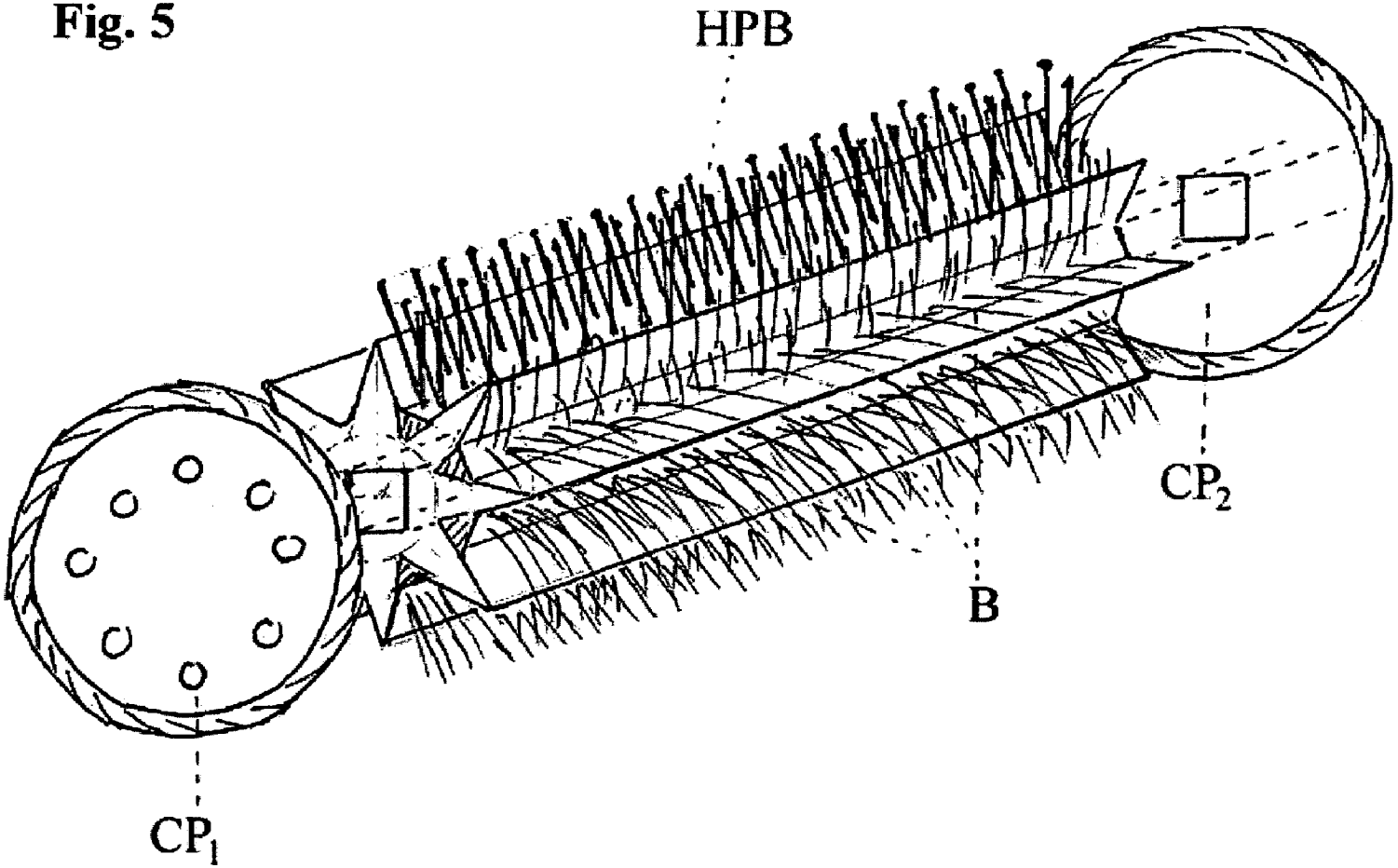
FIG. 5 shows an alternate embodiment of the present invention.

FIG. 5 shows an alternate embodiment of the rotating hairbrush, similar to FIG. 4. Here, the extension comb is replaced by an additional row of hard, plastic bristles (HPB) that would be used for de-tangling.

What i claim as my invention is:

1. A hair drying/styling device comprising:

a rotating hairbrush, said hairbrush comprising an elongate handle and an elongate head having a longitudinal axis rotatably supported on said handle; and a blow dryer affixed to the elongate handle; said blow dryer comprising a body portion affixed to said elongate handle of said hairbrush and an elongate outlet nozzle, said elongate nozzle being disposed above and parallel to said head of said hairbrush and including a plurality of plates therein to evenly distribute airflow at a 90 degree angle to the longitudinal axis of said head of said hairbrush;

said elongate head of said hairbrush comprising a substantially cylindrically shaped body; a plurality of substantially identical blades extending radially from said cylindrical body each of, said blades having a rounded distal edge; one said blade having a plurality of rigid teeth extending from the distal edge thereof so as to form a detangling comb; a plurality of notches disposed between the blades; at least two of said notches having a plurality of boar hair bristles disposed therein and extending radially beyond the edges of adjacent blades, at least one of said notches having said bristles therein being disposed adjacent said blade having said rigid teeth, and the remaining notches being free of bristles;

whereby when said head of said hairbrush is rotated, said rigid teeth detangle, section and guide hair, said boar hair bristles brush the sectioned hair while said distal edges of said blades tension the hair and straighten while said blow dryer simultaneously directs hot air to dry hair, and said notches which are free of hair eliminate tangling of the hair as the head is rotated and the hair is continued to be dried.

* * * * *